US008403316B2

(12) United States Patent
Ducherer et al.

(10) Patent No.: US 8,403,316 B2
(45) Date of Patent: Mar. 26, 2013

(54) METHOD AND APPARATUS FOR ASSEMBLING A WORKPIECE

(76) Inventors: Art Ducherer, Edmonton (CA); Daryl Garrison, Lloydminster (CA); Joseph Bowser, SW Calgary (CA); Timothy Brace, Lloydminster (CA); Terrance Forget, Marsden (CA); Blaine Ross, Lloydminster (CA)

( * ) Notice: Subject to any disclaimer, the term of this patent is extended or adjusted under 35 U.S.C. 154(b) by 0 days.

(21) Appl. No.: 13/246,349

(22) Filed: Sep. 27, 2011

(65) Prior Publication Data

US 2012/0014772 A1 Jan. 19, 2012

Related U.S. Application Data

(63) Continuation of application No. 12/914,469, filed on Oct. 28, 2010.

(60) Provisional application No. 61/312,517, filed on Mar. 10, 2010.

(51) Int. Cl.
*B23Q 3/00* (2006.01)

(52) U.S. Cl. ..... 269/316; 269/55; 269/309; 414/590

(58) Field of Classification Search ..... 269/319, 269/909, 329, 289 R, 63, 55, 58; 414/251, 414/227, 233, 590; 52/174
See application file for complete search history.

(56) References Cited

U.S. PATENT DOCUMENTS

| | | | | |
|---|---|---|---|---|
| 1,782,671 | A | | 11/1930 | Allred, Jr. |
| 1,872,810 | A | | 8/1932 | Raymond |
| 1,925,442 | A | | 9/1933 | Fournier |
| 2,605,540 | A | | 8/1952 | Kroll et al. |
| 2,691,448 | A | | 10/1954 | Lontz |
| 2,708,012 | A | | 5/1955 | Talcott |
| 2,732,177 | A | | 1/1956 | Ludowici |
| 2,794,901 | A | | 6/1957 | Christensen et al. |
| 3,018,546 | A | | 1/1962 | Dewese |
| 3,088,374 | A | | 5/1963 | Guyant et al. |
| 3,159,126 | A | | 12/1964 | Beecher |
| 3,197,045 | A | * | 7/1965 | Nevo-Hacohen ..... 414/248 |
| 3,239,927 | A | | 3/1966 | Hozak |
| 3,268,999 | A | | 8/1966 | Wiggins |
| 3,284,888 | A | | 11/1966 | McClain et al. |
| 3,378,151 | A | | 4/1968 | Salloum |
| 3,395,815 | A | | 8/1968 | Johnson |
| 3,436,518 | A | | 4/1969 | Persson |
| 3,653,395 | A | | 4/1972 | Chapman |
| 3,906,700 | A | | 9/1975 | Fujiwara et al. |
| 3,915,319 | A | | 10/1975 | Fairburn |
| 4,022,335 | A | | 5/1977 | Lambert, Jr. |
| 4,033,463 | A | | 7/1977 | Cervin |
| 4,039,089 | A | | 8/1977 | Kochanneck |
| 4,074,847 | A | | 2/1978 | McFatter |
| 4,121,747 | A | | 10/1978 | McFatter |
| 4,142,284 | A | | 3/1979 | Steuber |

(Continued)

FOREIGN PATENT DOCUMENTS

| | | |
|---|---|---|
| CA | 1096576 | 3/1981 |
| CA | 1180160 | 1/1985 |

(Continued)

*Primary Examiner* — Lee D Wilson
(74) *Attorney, Agent, or Firm* — Michael G. Johnston; Moore & Van Allen PLLC

(57) ABSTRACT

There is disclosed an elevator for holding a workpiece, the elevator comprising a turntable and adapted to slide along a support chain to thereby vertically displace the elevator. There is further disclosed a method of assembling a workpiece, the method comprising the steps of stacking first and second workpiece sections on a turntable elevator; and sliding the elevator along a support chain to thereby vertically position the workpiece.

10 Claims, 12 Drawing Sheets

U.S. PATENT DOCUMENTS

| | | | | | |
|---|---|---|---|---|---|
| 4,177,915 | A | | 12/1979 | Blankenburg | |
| 4,494,291 | A | | 1/1985 | Morrison | |
| 4,599,123 | A | | 7/1986 | Christensson | |
| 4,618,757 | A | | 10/1986 | Cabany et al. | |
| 4,636,645 | A | | 1/1987 | Kessinger | |
| 4,664,307 | A | | 5/1987 | Curry et al. | |
| 4,664,575 | A | * | 5/1987 | Ohmura et al. | 414/788.7 |
| 5,217,188 | A | | 6/1993 | Thole et al. | |
| 5,294,078 | A | | 3/1994 | Gurr | |
| 5,370,206 | A | | 12/1994 | Chao | |
| 5,565,621 | A | * | 10/1996 | Selby et al. | 73/54.28 |
| 5,980,185 | A | * | 11/1999 | Vita | 414/254 |
| 6,004,091 | A | | 12/1999 | Roth | |
| 6,212,832 | B1 | * | 4/2001 | Gao | 52/174 |
| 6,266,862 | B1 | | 7/2001 | Oostwouder et al. | |
| 6,282,863 | B1 | | 9/2001 | Christian et al. | |
| 6,591,476 | B2 | * | 7/2003 | DeCecca et al. | 29/464 |
| 7,500,592 | B1 | | 3/2009 | Petricio Yaksic | |
| 2008/0277208 | A1 | * | 11/2008 | Barone | 187/273 |
| 2011/0222998 | A1 | * | 9/2011 | Ducherer et al. | 414/590 |
| 2012/0014772 | A1 | * | 1/2012 | Ducherer et al. | 414/590 |

FOREIGN PATENT DOCUMENTS

| | | | |
|---|---|---|---|
| CA | 2479412 | A1 | 2/2006 |
| CA | 2567024 | A1 | 3/2008 |
| CA | 2709563 | A1 | 1/2012 |
| ES | 8602456 | A1 | 3/1986 |
| ES | 2134107 | A1 | 9/1999 |
| GB | 528401 | | 10/1940 |
| GB | 800822 | | 9/1958 |
| GB | 833964 | | 5/1960 |
| GB | 842272 | | 7/1960 |
| GB | 948672 | | 2/1964 |
| GB | 1155491 | | 6/1969 |
| GB | 1500498 | | 2/1978 |
| JP | 59066981 | A | 4/1984 |
| JP | 2104871 | A | 4/1990 |
| JP | 7034711 | A | 2/1995 |
| JP | 8004351 | A | 1/1996 |
| JP | 11152180 | A | 6/1999 |
| JP | 2002038545 | A | 2/2002 |
| WO | 02087804 | A1 | 11/2002 |

* cited by examiner

METHOD AND APPARATUS FOR ASSEMBLING A WORKPIECE

CROSS-REFERENCE TO RELATED APPLICATION

This application is a continuation application of U.S. patent application Ser. No. 12/914,469, filed Oct. 28, 2010, which claims the benefit of U.S. Provisional Application No. 61/312,517, filed Mar. 10, 2010, the contents of both of which are hereby incorporated by reference in their entirety.

FIELD

The subject matter disclosed generally relates to a method and apparatus for assembling a workpiece.

BACKGROUND

U.S. Pat. No. 1,872,310 to Raymond discloses a fabrication facility comprising an elevator in a vertical shaft below ground U.S. Pat. No. 3,395,815 Johnson discloses a rotatable elevator platform which is motor driven moving up and down in a shaft and suspended from cables.

U.S. Pat. No. 3,915,319 Fairburn discloses a platform bearing a hydraulically powered turntable suspended on cables with counterweights Canadian Patent No. 2,479,412 Bertelsen, filed Aug. 26, 2004 and Canadian Patent Application No. 2,567,024, Bertelsen, filed Sep. 14, 2006, claim methods and apparatuses by which multi-stage work pieces are constructed on adjustable platforms.

SUMMARY

In a first embodiment there is disclosed an elevator for holding a workpiece. The elevator may comprise a turntable and may be adapted to slide along a support chain to thereby vertically displace the elevator In another embodiment there is disclosed an elevator system. The system may comprise the elevator disclosed herein and may further comprise the support chain, and wherein the support chain may have two fixed ends, the elevator may move relative to both of the fixed ends, and wherein the sliding may occur at a point distant from a the end In alternative embodiments, the chain may be a roller chain and may be adapted to be rotation damped. The chain may have an associated drive. The drive may comprise a powered sprocket for displacing a length of the chain to thereby vertically displace the elevator. The elevator may move vertically in a shaft that may extend below ground level and the chain may contact the drive at a drive point, and wherein a first length of the chain may extend on a first side of the drive point; a second length of the chain may extend on a second side of the drive point; and wherein the platform may be supported on the first length and the counterweight may be supported on the second length.

In alternative embodiments, the chain may be an end and the end may be fixed relative to the drive and between two mutually opposed and secured chain engaging combs In alternative embodiments, the turntable may comprise a workpiece receiving lug and the lug may be shaped to releasably accept a cooperating guide member In another embodiment, there is disclosed a method of assembling a workpiece. The method may comprise the steps of: stacking first and second workpiece sections on a turntable elevator; and sliding the elevator along a support chain to thereby vertically position the workpiece In alternative embodiments, the method may further comprise the step of rotating the turntable relative to a workstation. The support chain may be a roller chain In alternative embodiments, the method may further comprise damping unwanted rotation of the elevator. The vertical positioning may be below ground level In alternative embodiments, the method may further comprise longitudinally displacing the chain at a drive point on the chain, and wherein a first length of the chain may extend on a first side of the drive point; and a second length of the chain may extend on a second side of the drive point; and wherein the method may further comprise slidingly suspending the platform from the first length and suspending a counterweight from the second length In alternative embodiments, the method may further comprise using a drive sprocket to drive the displacing of the chain and welding together the sections In another embodiment, there is disclosed a workpiece holding apparatus. The apparatus may comprise a workpiece supporting turntable elevator actuable to support a workpiece and to position the workpiece vertically and circumferentially relative to a workstation In alternative embodiments, the platform may be slideably suspended on a supporting chain and wherein the vertical positioning may comprise sliding the platform along the support chain. The sliding may be driven by a drive that may contact the chain at a drive point, and wherein a first length of the chain may extend on a first side of the drive point and a second length of the chain may extend on a second side of the drive point and the apparatus may further comprise a counterweight slidingly suspended from the first length and the platform may be slidingly suspended from the second length. The chain may be a roller chain. The workpiece may be substantially cylindrical.

In another embodiment, there is disclosed a tank made using the apparatus disclosed herein.

In another embodiment, there is disclosed a method of assembling a workpiece on an elevator. The method may comprise: positioning the workpiece on a turntable on the elevator; vertically positioning the workpiece by suspendedly sliding the elevator along a support chain; and rotationally positioning the workpiece by rotating the turntable.

In alternative embodiments, the method may comprise vertically displacing the elevator in a shaft to thereby position the workpiece relative to a workstation and wherein the workstation may be proximate ground level. The elevator may comprise a frame and the method may further comprise damping unwanted rotation movement of the elevator frame and displacing the chain at a drive point, and a first length of the chain may extend on a first side of the drive point and a second length of the chain may extend on a second side of the drive point; and the method may further comprise suspending a counterweight from the first length and slidingly suspending the platform from the second length. The method may comprise using a drive sprocket for displacing the chain.

In alternative embodiments the method may be a method of welding.

In alternative embodiments, the method may further comprise the step of: stacking two workpiece sections on the turntable; positioning the elevator vertically relative to a workstation; and rotating the stacked segments relative to the workstation so that the stacked segments can be joined effectively by a welder at the workstation.

In another embodiment, there is disclosed a method for continuously welding a joint in a hollow workpiece having first and second faces. The method may comprise: providing a first welder positioned to access the first face of the joint; rotating the workpiece simultaneously with the operation of the welder to thereby form a continuous weld along a length of the first face of the joint.

In alternative embodiments, the method may further comprising the steps of: providing a second welder positioned to access the second face of the joint in opposed relationship to the first welder, moving the joint between the first and second welders to thereby continuously simultaneously weld both first and second faces of the joint. The workpiece may be cylindrical and the workpiece may be mounted on a rotating turntable. The method may further comprise damping unwanted rotation of the elevator.

In alternative embodiments, one of the first and second welders may be positioned inside the cylinder and one of the first and the second welders may be positioned outside the cylinder. The turntable may be comprised in an elevator actuable to slide along a support chain to thereby vertically displace the elevator.

Features and advantages of the subject matter hereof will become more apparent in light of the following detailed description of selected embodiments, as illustrated in the accompanying Figures. As will be realized, the subject matter disclosed is capable of modifications in various respects. Accordingly, the drawings and the description are to be regarded as illustrative in nature, and not as restrictive.

DETAILED DESCRIPTION OF THE PREFERRED EMBODIMENTS

Terms

Figure 1:
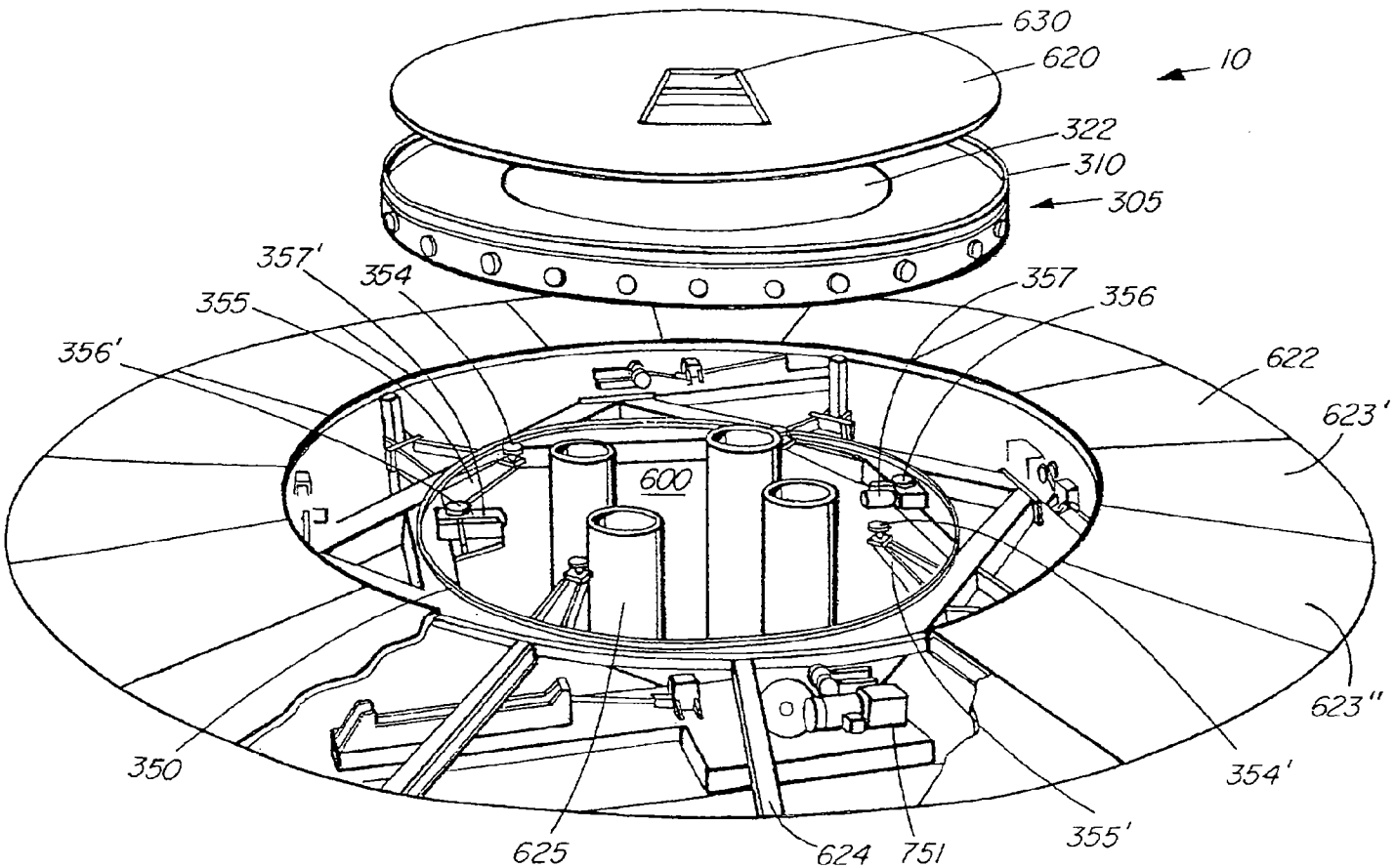
FIG. 1 is a cutaway and partly exploded ground level view of a first embodiment.

In this disclosure, the term "comprising" is used in a non-limiting sense to mean that items following the word are included, but items not specifically mentioned are not excluded. A reference to an element by the indefinite article "a" does not exclude the possibility that more than one of the elements is present, unless the context clearly requires that there be one and only one of the elements.

In the disclosure the term "elevator" means a moving or moveable platform or device for moving items, which may be workpieces or portions thereof, from one level of elevation to another level of elevation. An elevator may comprise a supporting frame which may also be referred to as a platform or hoist platform, and may comprise a turntable which may be supported on the frame or otherwise mounted or associated therewith. An elevator or turntable may be adapted to hold, carry, rotate and otherwise accommodate the weight of a workpiece. It will be appreciated that in embodiments the word elevator may encompass a range of accessory apparatus required to cause and control the vertical movement of the elevator frame and its associated attachments. Where used herein the term elevator is not limited to a fully assembled elevator system and may include or refer to an isolated platform and turntable assembly suitable for movement by appropriate supporting and powering devices, or may also include such accessory structures as supporting chains, brackets and the like. In some instances an elevator is referred to as a turntable elevator to reflect the incorporation of a rotary turntable into the elevator. For greater certainty the term "elevator system" may be used to denote a more complete apparatus comprising not only an elevator (ie. comprising an elevator or hoist platform and its associated turntable) but also necessary accessory structures such as supporting chains, power sources, guides and the like.

In this disclosure the term "workpiece" or "work piece" means any item to be worked or machined or assembled or modified. In embodiments a workpiece may comprise one or more sections that may be sequentially joined to form an elongated structure which may have any cross section compatible with the geometry and size of the shaft, platform, and workpiece holder used. In embodiments the workpiece may be a tank or portion of a tank and may be metal, plastic, ceramic or any suitable material. By way of illustration and not limitation, a tank may be an oil tank, gas tank, water tank, silo or any other form of container. Although typically substantially circular in cross section, oval, square or other configurations are possible with suitable modifications readily apparent to those skilled in the art. In embodiments the free ends of two sections may be placed in mutual proximity so that the sections can be joined and subsequent sections added thereto, and in embodiments the free ends may be preformed for mutual joining by the provision of bolt holes, clips, lugs, rims and any form of other structures or adaptations useable to facilitate mutual joining of the sections. It will be understood that in embodiments a method for constructing or assembling a workpiece herein may comprise a method for stacking out a tank. In embodiments sections of a workpiece may be or may include open ended cylinders and may be stacked for assembly. Particular embodiments may be suitable to accept and/or fabricate workpieces or containers with continuous side walls that have a weight more than about 3,000 lbs, 5,000 lbs, 6,000 lbs, 7,000 lbs, 8,000 lbs, 10,000 lbs, 15,000 lbs, 20,000 lbs, 30,000 lbs, 40,000 lbs, 50,000 lbs, 60,000 lbs, 70,000 lbs, 80,000 lbs, 90,000 lbs or greater than about 100,000 lbs.

In this disclosure the term "workpiece holder" means a structure configured to hold and retain a workpiece to be worked on. In embodiments it may take the form of or may comprise clamps, lugs, restraining rings, guides, channels, restraints, recesses, and the like suitable to hold a workpiece while work is carried out on said workpiece. In embodiments the workpiece holder may be configured to accept a metal or other sheet or segment of a workpiece to hold same sufficiently securely to be worked on.

In this disclosure the term "workstation" means any location that is suitable for a worker or an apparatus to carry out an assigned task, a workstation may simply be an location to be occupied by a suitable worker or machine, or in embodiments it may comprise equipment such as a robot welder.

In this disclosure the term "guide rod" "guide element" or "guide" means a structure for guiding and/or stabilising the movement of an element such as a workpiece or an elevator. In embodiments a guide may be a rod, bar, slide, chain, surface, column or channel or other suitable structure which is able to restrict or direct the movement of some other element. For greater certainty, in embodiments the term guide is used with reference to structures used to direct the placement of a workpiece or workpiece section into a lug or other retaining structure and also with reference to structures that serve to direct or limit the movement of a platform or elevator. Those skilled in the art will readily understand such references in light of their context.

In this disclosure the term "rotation damper" or "damper" means a device or structure or combination of the foregoing, whose effect is to restrict rotation of an object. In particular embodiments a rotation damper may be used to prevent undesired rotation of elevator or of a supported workpiece, for instance counter-rotation of an elevator arising from the torque forces of a rotating turntable. In embodiments dampers may comprise or cooperate with suitable guide structures. In particular embodiments a damper may comprise a shoe mounted on an elevator platform and sized to slidingly cooperate with a suitably disposed vertical guide rod. Alternative forms of damper may include or comprise projecting elements that slidingly engage with a suitable groove or recess, springs, shock absorbers and the like.

In this disclosure the term "pad" means a cushion or plate or surface of any material suitable for maintaining sliding contact with a guide and may have low coefficients of friction and may be lubricated. Without limitation pads of particular embodiments may comprise plastic, rubber, wood, metal or the like and may comprise Nylotron™. In embodiments pads may be replaced with ball bearings, wheels, rollers or other similar structures that permit reasonably stable but slideable engagement between parts.

In this disclosure the term "chain" means an elongated structure comprising a series of sequentially connected links. A chain may be of any design but in particular embodiments may be a roller chain, an inverted tooth chain or a leaf chain. In embodiments the chain may be a roller chain. In embodiments the chain may comprise sequential links having commonly oriented openings and suitable to engage the teeth of a cooperating sprocket. Similarly in embodiments a chain may be configured to bear projecting elements suitable to engage cooperating openings on a cog, wheel, chain or other suitably configured structure.

In this disclosure the term "support chain" means a chain suitable to support at least a portion of the weight of a platform or elevator, or an elevator or platform bearing a workpiece. It will be understood that for an particular desired usage, the materials, dimensions, tolerances and other parameters of such a chain, and of any cooperating structures, will be readily chosen and implemented by those skilled in the art.

In this disclosure the term "drive" means a means for powering movement of an element and may comprise a power source and a suitable wheel or sprocket suitable to actuate movement of another element. Where used with respect to the vertical movement of an elevator the term drive may be used to refer to a power source suitable to actively displace the elevator along the length of a support chain by frictional or other contact, between a support chain and a drive element which may be or comprise a drive sprocket powered by a suitable power source. In embodiments the support chain, which may be a roller chain, and the active displacement may be driven by a motor driven sprocket engaging the chain and thereby moving the platform therealong. The term "direct drive" denotes that the power from the drive is applied to cause movement of a subject element, thus a directly driven turntable is moved by rotation of powered drive rollers that frictionally contact a surface of the turntable and by their own rotation cause rotation of the turntable itself. In alternative embodiments a drive may comprise interlocking teeth, sprocket wheels, belts, chains and other suitable power transmission means whose use and operation will be readily apparent to those skilled in the art. It will be understood that drives may have adjustable gearing, speed and power settings and may be controlled or coordinated by a control unit.

In this disclosure the term "section" means a section or portion or element of a desired complete workpiece. In particular embodiments where a completed workpiece is generally cylindrical, the sections may likewise be generally cylindrical or tubular, but it will be understood that any cross section may be utilised with suitable adaptations to the method and apparatus disclosed, all of which will be readily understood and implemented by those skilled in the art. In embodiments two or more sections may be stacked for joining, and it will be understood that such stacking may be generally end-to-end and may align the sections for joining.

In this disclosure the term "robot" means any form of robotic or automated or semi-automated device and may include welding robots and may include individual such robots and pluralities of such robots which may be connected and coordinated in ways readily apparent to those skilled in the art.

In this disclosure any wheels, rollers, sprockets, cogs and other rotating structures may be in any suitable form and may be coated, tapered, treated, balanced or oriented in a variety of ways. They may be provided individually, and may be provided in pluralities of any suitable number and may be disposed in opposed pairs, triplets and the like. They may be adapted to engage a cooperating support chain by the provision of teeth, recesses, hooks, ridges, friction pads or other adaptations, all of which will be readily understood by those skilled in the art.

In this disclosure the term "coordinate" where applied to the movement or operation of elements means that the speed, motion and other operational parameters of the elements are collectively regulated. Such regulation may be carried out or configured so that the cumulative effect of rotation speed, workpiece position, and welding operation, result in a desired movement pattern of an element or apparatus. It will be appreciated that such coordination of the elements of the joining method, which may be a welding method, and of apparatus disclosed herein may be achieved by a variety of systems and methods, which will be readily implemented by those skilled in the art who will readily establish desirable parameters for particular workpieces and results.

In this disclosure the term "slidingly" or "slideably" means that two or more parts may be displaced relative to each other while remaining in close proximity or contact. Such relative sliding movement may be achieved or facilitated using pads, wheels, rails, lubricants, chains, cords, ropes, bearings, sprockets and any other form of sliding contact or sliding relative relationship, which may include a rolling relationship or rolling engagement such as that between a sprocket and a cooperating chain. In a particular embodiment a sliding relationship between a platform and a support chain refers to an arrangement of one or more sprockets on a platform whereby as the platform moves the sprocket or sprockets will roll along the chain. A wide range of alternatives will be readily understood and implemented by those skilled in the art.

In this disclosure the term "joining" or "join" denotes the act of mutually securing two or more surfaces or structures. Joining may be achieved in any conventional ways by melting, welding, bolting, screwing, gluing, adhering, sticking or otherwise mutually securing two opposed elements in any conventional manner. A wide variety of methods of joining segments of a workpiece will be readily identified and implemented by those skilled in the art. In embodiment joining may comprise welding.

In this disclosure the term "welding" has its ordinary meaning. In embodiments welding may refer to the welding of metal substrates but in alternative embodiments the substrates to be welded may be plastic or some other material In this disclosure the singular forms a "an", and "the" include plural referents unless the content clearly dictates otherwise. Thus, for example, reference to a composition containing "a compound" includes a mixture of two or more compounds.

In this disclosure term "or" is generally employed in its sense including "and/or" unless the content clearly dictates otherwise.

For ease of comprehension the description of embodiments is divided into sections, separately describing the overall design of embodiments, the design of the elevator platform, the suspension and movement of the platform, guide structures to guide movement of the elevator, associated control features, and methods of using the apparatus disclosed. A first embodiment is described generally with reference to FIGS. 1 through 13.

1. General Description of a First Embodiment

A first embodiment generally designated 10 is described generally with reference to FIGS. 1 through 13. The more general features are explained with particular reference to FIGS. 1, 2, 4, 6 and 7 and comprises an elevator 300 for supporting a workpiece 400 having a sidewall 410 with first face 415 and second face 416, which may be inner and outer faces or surfaces of a workpiece that is substantially hollow. In particular embodiments the workpiece may be a tank and may be substantially cylindrical.

The elevator 300 (shown particularly in FIG. 6) may comprise a turntable 305 bearing a workpiece holder 310 and supported on an elevator frame or platform 315, and may be adapted to be slidingly suspended from at least one support chain 500 by at least one sprocket 320 or equivalent device suitable to allow the elevator to be slidingly displaced along the chain 500. The chain 500 or a plurality of chains 500 may support all or part of the weight of the elevator 300

In an embodiment the elevator 300 may be suspended in a shaft 600 having walls 605, a bottom 610 and an upper open end 615 that may be proximate ground level. The shaft may be divided into upper 606 and lower 607 sections having different dimensions. The elevator may be ring shaped with a central space 322 sized to accommodate pillars 625 or equivalent support structures which may support a central or inner workstation 620 which may be mounted on the pillars. The elevator 300 may surround the pillars 625 and in turn the elevator 300 and shaft 600 may be surrounded by an outer workstation 622 which may comprise individual suitably sized metal plates 623, supported on a suitable frame 624. The elevator may be at any allowed height within the shaft 600.

In embodiments the shaft walls 605 may be or may comprise concrete, stone, metal, plastic or any suitable material and may be concrete lined with metal facing and the workstations 620, 622 may be proximate ground level. A variety of constructions are equally possible and will be readily selected from and implemented by those skilled in the art.

The central workstation 620 may comprise an associated access hatch 630 and may have an associated ladder, elevator or the like for access to the interior of the shaft, and associated additional workstations may be provided at different levels in or above the shaft for maintenance or other purposes. In various alternative embodiments the apparatuses and methods disclosed may be suitable for the assembly of workpieces that are generally cylindrical and are assembled from a series of end to end cylindrical sections, but in alternative embodiments and with suitable modifications it may be possible to use the apparatuses and methods disclosed herein with a variety of workpiece configurations. It will be understood that the overall dimensions of the apparatus, workstations and other components may be adjusted as may be necessary or desirable for handling workpieces of particular shapes and sizes, all in ways readily understood by those skilled in the art.

In embodiments the general embodiment 10 may be characterised in that it comprises a workpiece supporting turntable elevator 300 actuable to support a workpiece 400 and to position the workpiece 400 vertically and circumferentially relative to a workstation 620 or 622 or to workstations 620 and 622. In embodiments the elevator 300 may be slidingly suspended on a supporting chain 500 and the vertical positioning of the elevator 300 may comprise sliding the elevator 300 along the support chain 500.

There is also generally disclosed an apparatus generally designated 10 for continuously welding a joint 420 in a workpiece 400 which may be hollow and having first and second faces 415, 416, the apparatus comprising a turntable elevator 300 for rotating the workpiece 400 a first welder 640 or second welder 641 positioned to access the first face 415 or second face 416 of the joint 420. The turntable 305 may be actuable to rotate the workpiece 400 relative to the one or more of welders 640 and 641 to so that the welder is able to form a continuous weld along a length of the first face 415 or second face 16 of the joint 420 without moving substantially from a chosen position relative to the workpiece 400.

Accordingly there is generally disclosed an elevator system for holding a workpiece 400, the elevator 300 comprising a turntable 305 and actuable to slide along a support chain 500 to thereby vertically displace the elevator 300. In embodiments the support chain 500 may have first 502 and second 504 fixed ends and the sliding may occur at one or more support sprockets 320 and may occur at a point on the support chain 500 distant from one of the ends 502, 504. The elevator 300 may be adapted by the incorporation of one or more dampers 517, which may comprise a shoe 515 mounted on the elevator frame and sized to slidingly contact a fixed guide 519, which may be a rod, bar, groove, or other rigid guide structure suitable to cooperate with suitable stabilising structure on the frame. The cooperation between the damper shoes 515 on the frame and the guide 519 serving to damp unwanted rotation of the elevator 300 such as may occur when the turntable 305 is operated, particularly when operated bearing a heavy workpiece. Shoe 515 may comprise contact pads 518 which may comprise Nylotron™.

2. Design and Operation of the Elevator

Figure 10:
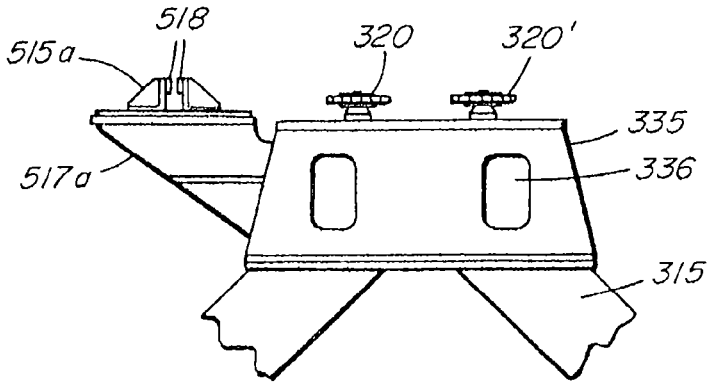
FIG. 10 is a hoist platform extension according to an embodiment.

The elevator 300 generally may be best understood with reference to FIGS. 1, 2, 3, 5, 6 and 13 and it will be seen from the drawings that elevator 300 comprises a platform or frame 315 bearing the rotatable turntable 305. Frame 315 may comprise four projections or surfaces 330 bearing sprockets 320 or their equivalent for slidingly suspending the elevator frame 315 from chains 500 so that longitudinal movement of the elevator 300 along chain 500 causes vertical movement of the elevator 300. It will be understood that any suitable number of projections may be used, their number and positioning being selected by those skilled in the art to permit the balanced movement of the elevator 300. In an alternative embodiment the sprockets 320 may be mounted on hoist platform extensions 335 as shown in FIG. 10 which may be secured to the platform or frame 315 and may comprise openings 336. It will be understood that in alternative embodiments the sprockets 320 may be mounted in a range of ways, and in a variety of configurations, all so as to position the sprockets 320 appropriately to accept chain 500. In the illustrated embodiment each hoist platform extension 335, or each group of sprockets may comprise two idler lift sprockets 320 but alternative numbers of sprockets 320 may be selected and similarly alternative numbers of groups of sprockets or platform locations therefor may be selected amongst. Those skilled in the art will readily identify and choose between alternative configurations Also comprised in the platform or frame 315 may be one or more damper assemblies generally designated 517. This assembly may contain a shoe 515 sized to slide along guide bars or rods 519 (also referred to simply as "guides") that may be any suitable shape, including flat or rectangular, and that may be vertically aligned and secured in the shaft 600. The guide shoes 515 may comprise contact pads 518 to allow easy sliding along the guide bar 519. As shown in FIG. 10, in alternative embodiments the damper 517 and its shoe 515 may be comprised in a hoist platform extension 335 (wherein they are labelled 517*a* and 515*a*), in which case the arrangement of guides 519 may be adjusted accordingly.

In the illustrated embodiment the elevator frame or hoist platform 315 (which may be best understood with particular reference to FIGS. 1, 2, 3, 5, 6 and 13) may comprise a track 350 to bear the weight of the turntable 305 and may comprise idler rollers 441 and centralising rollers 354. The track 350 may be mounted on top of the elevator frame 315. The centralising rollers 354 and the idler rollers 441 may comprise a plurality of mutually spaced rollers and a variety of suitable arrangements will be readily identified and implemented by those skilled in the art. In embodiments there are also provided vertically oriented drive rollers 356, powered by motors 357 to drive movement of the turntable 305. The drive rollers 356 may be friction rollers, and the drive may be a direct friction drive. As will be seen with particular reference to FIG. 13A, flange 446 of the turntable 305 comprises a downwardly projecting inner rim 448. Drive rollers 356 frictionally engage the outer face of rim 448 to rotate the turntable 305.

In embodiments there may be two or more drive rollers 356 which may be disposed at opposite sides of the frame 315. The rotation of a drive roller 356 may be actuated by a control system. In alternative embodiments there may be provided a large segmented sprocket to drive rotation of the workpiece holder (ie there may be engaging teeth around the outside the outside of the turntable and the drive sprocket may directly engage those teeth to turn the turntable). In an alternative embodiment the rotation of the turntable may be driven by a powered chain. The motor may be a stepper motor or a standard motor or any other suitable power source as desired by an operator. In embodiments the rollers may have a urethane coating and may be mounted on an eccentric mounting plate to facilitate fine tuning of the turntable apparatus. In alternative embodiments there may be provided any suitable numbers of drive rollers 356, centralising rollers 354 and idler rollers 441. It will be seen that turntable 305 is rotatable substantially on a plane Y which may be substantially perpendicular to the depth axis of the shaft 600. Generally the plane Y will be substantially horizontal but in embodiments may be angled.

Figure 13A:
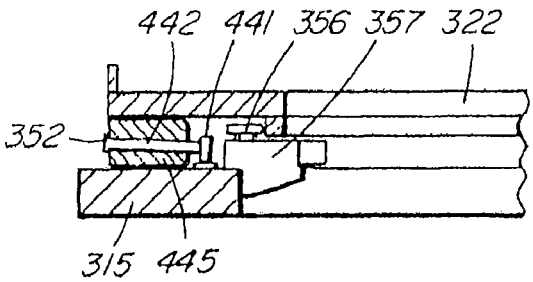
FIG. 13A is a partial cross section through an elevator assembly of the first embodiment, showing a drive motor assembly.
Figure 13B:
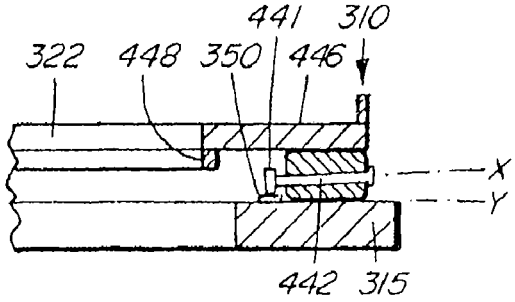
FIG. 13B is a complementary partial cross section to FIG. 13A, taken in a region distant from the drive motor assembly.

As will be seen with particular reference to FIGS. 13A and 13B idler rollers 441 may be mounted on axles 442 projecting through turntable body 445, and visible on the external surface of the turntable as projecting axle ends 352. The idler rollers 441 may rest on a supporting track 350 and idler roller axles 442 may have a corresponding axis of rotation X which may be offset from the plane Y of the elevator frame 315 by an angle β. In embodiments the angle β may be between about 0.5 and 10 degrees, may be between about 1 and 3 degrees, or between about 1.5 and 2.5 degrees or may be about 2 degrees. As shown for example in FIGS. 1, 6, and 13 the axles 442 of the idler rollers 441 may extend through and be anchored in the body 445 of the turntable 305 and project on the outside thereof as axle ends 352. The weight of the turntable and any workpiece may be supported partly or wholly on the idler rollers. The centralising rollers may be mounted on supports 355.

Figure 11A:
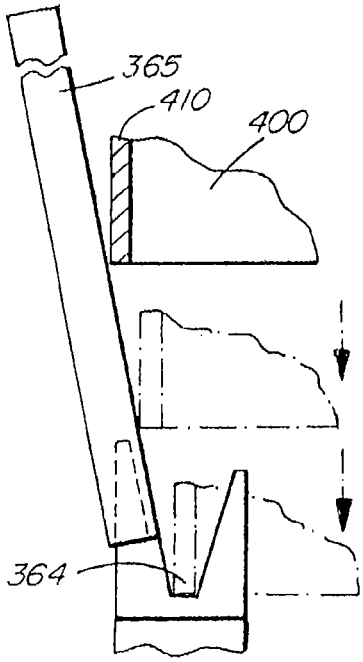
FIGS. 11A and B show a lug according to the first embodiment.
Figure 11B:
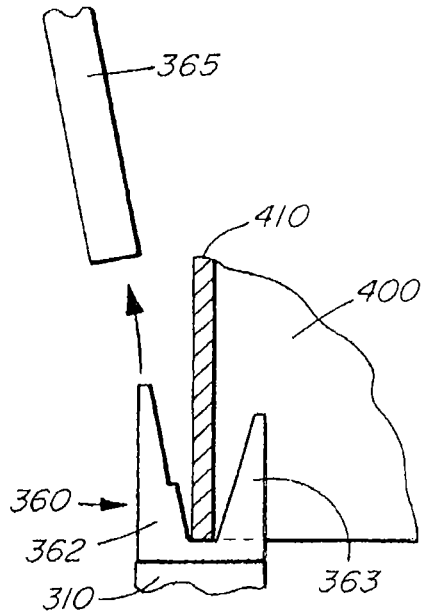

With particular reference to FIGS. 11A and 11B, in embodiments the turntable 305 may comprise a workpiece holder (which may be or may comprise a ring or riser) 310 bearing thereon lugs 360. A lug 360 may comprise a first limb 362, and a second limb 363 defining therebetween a workpiece receiving notch 364. One of the limbs may be adapted to detatchably accept a guide element 365 which may be a hollow rod and may be have a square cross section and may be a steel tube and may be shaped and sized to snugly and releasably fit over or otherwise engage one of the limbs 362, 363. FIG. 11A shows a lug 360 with a guide element 365 in place to guide workpiece 400 into notch 364 as it is lowered, and FIG. 11B shows the workpiece 400 in place with the guide element 365 removed.

An edge 425 of the workpiece 400 may be accepted in notch 364 in the lug 360 which is mounted. In an embodiment a user may be able to reversibly position a guide element 365 on a limb of the lug 360 to guide a workpiece edge 425 into place to sit in notch 364 and the user may then remove the guide element 365.

In an embodiment a turntable 305 may comprise a suitable plurality of lugs disposed about the periphery of the workpiece holder 310 bearing the lugs 360. It will be understood that the dimensions of the workpiece holder 310 and the size, number and spacing of the lugs will be chosen to correspond suitably with the dimensions of the workpiece to be used. In alternative embodiments there may be provided any suitable number of lugs 360 and the dimensions and separation of the lugs 360 may be adapted to suit the requirements of a user.

The dimensions, configurations and numbers of rollers, tracks, lugs, sprockets and other components will all be readily adjusted by those skilled in the art to suit particular requirements. All such adjustments will be readily recognised and implemented by those skilled in the art.

3. Suspension and Vertical Movement of the Elevator

Figure 4A:
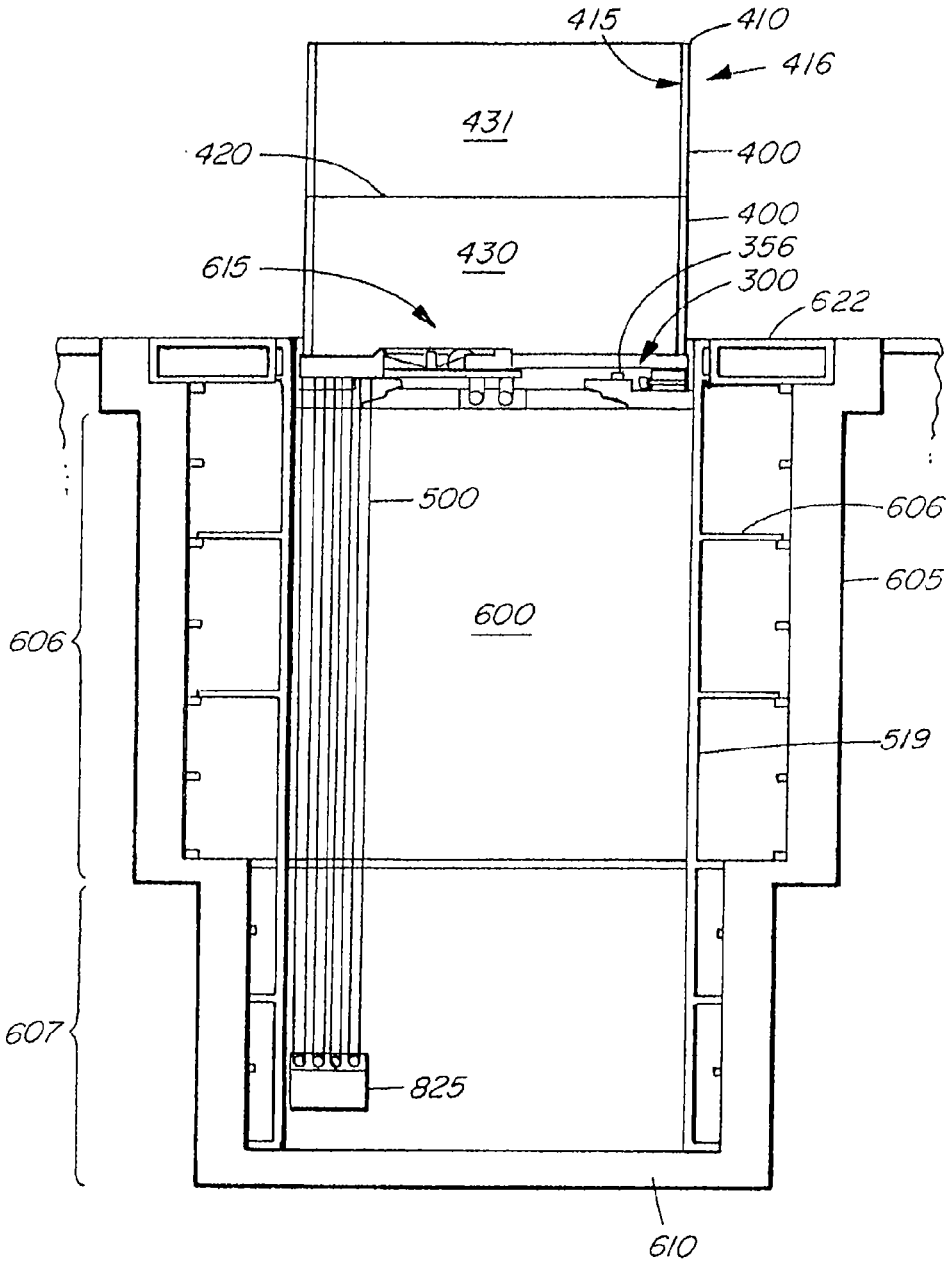
FIG. 4A is a simplified vertical section of the embodiment according to FIG. 1, with the central columns omitted for clarity and with the elevator raised.
Figure 4B:
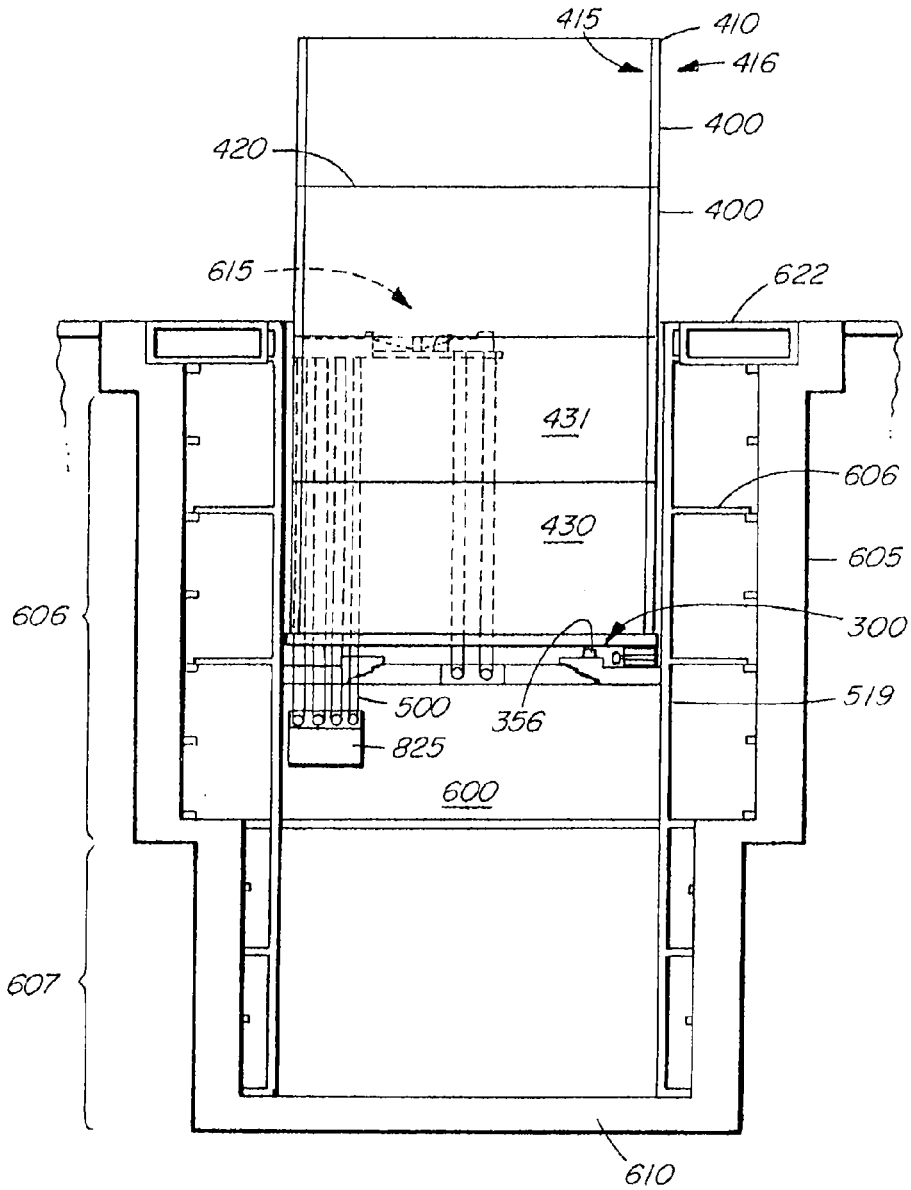
FIG. 4B is an equivalent view to FIG. 4A but shows the elevator partly lowered.
Figure 5:
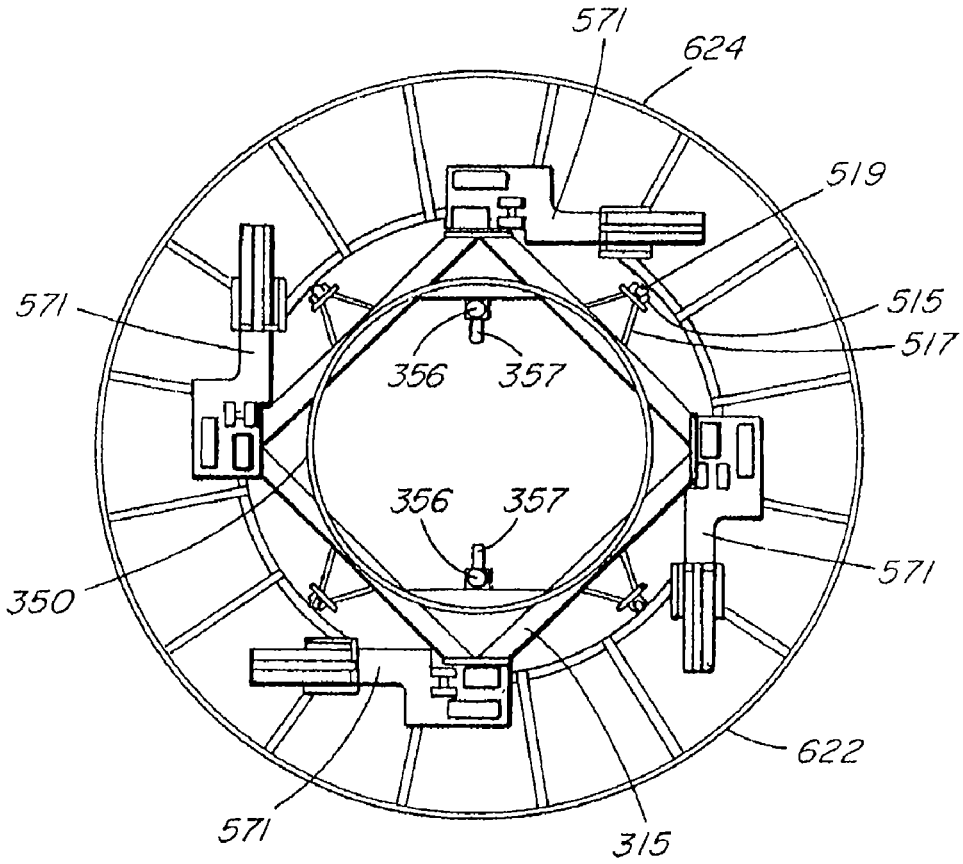
FIG. 5 is a top view of the first embodiment showing the drive motors and elevator platform.
Figure 6:
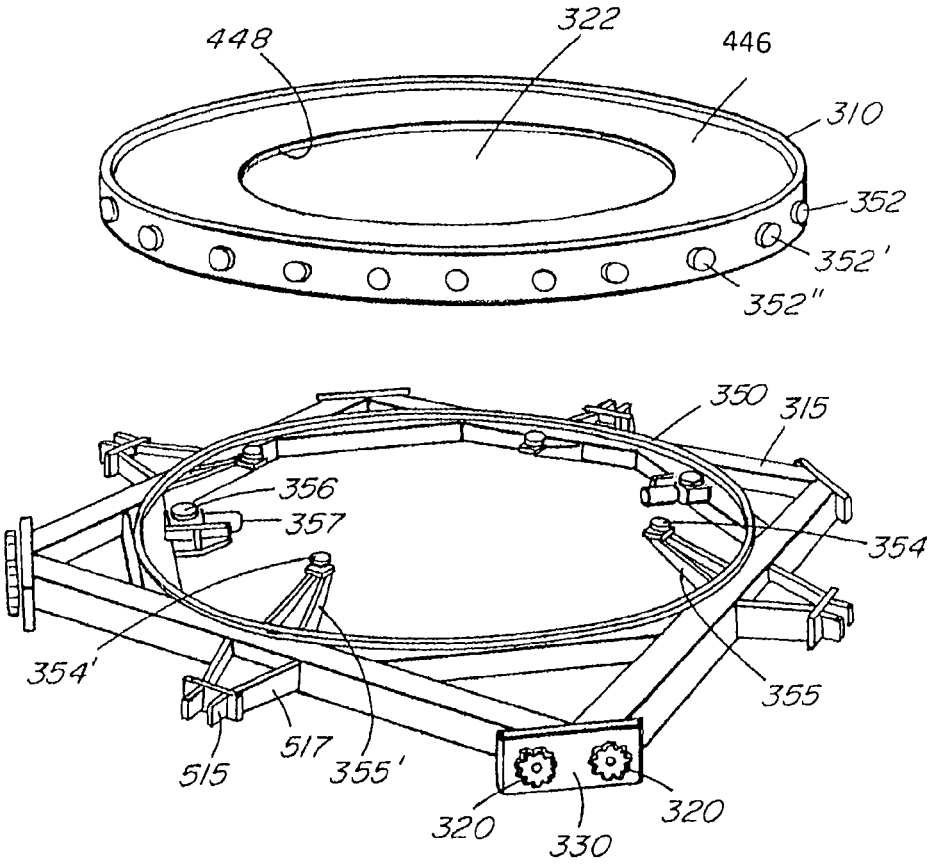
FIG. 6 is an exploded view of a portion of the first embodiment showing the turntable and elevator frame/platform according to FIG. 1.
Figure 7:
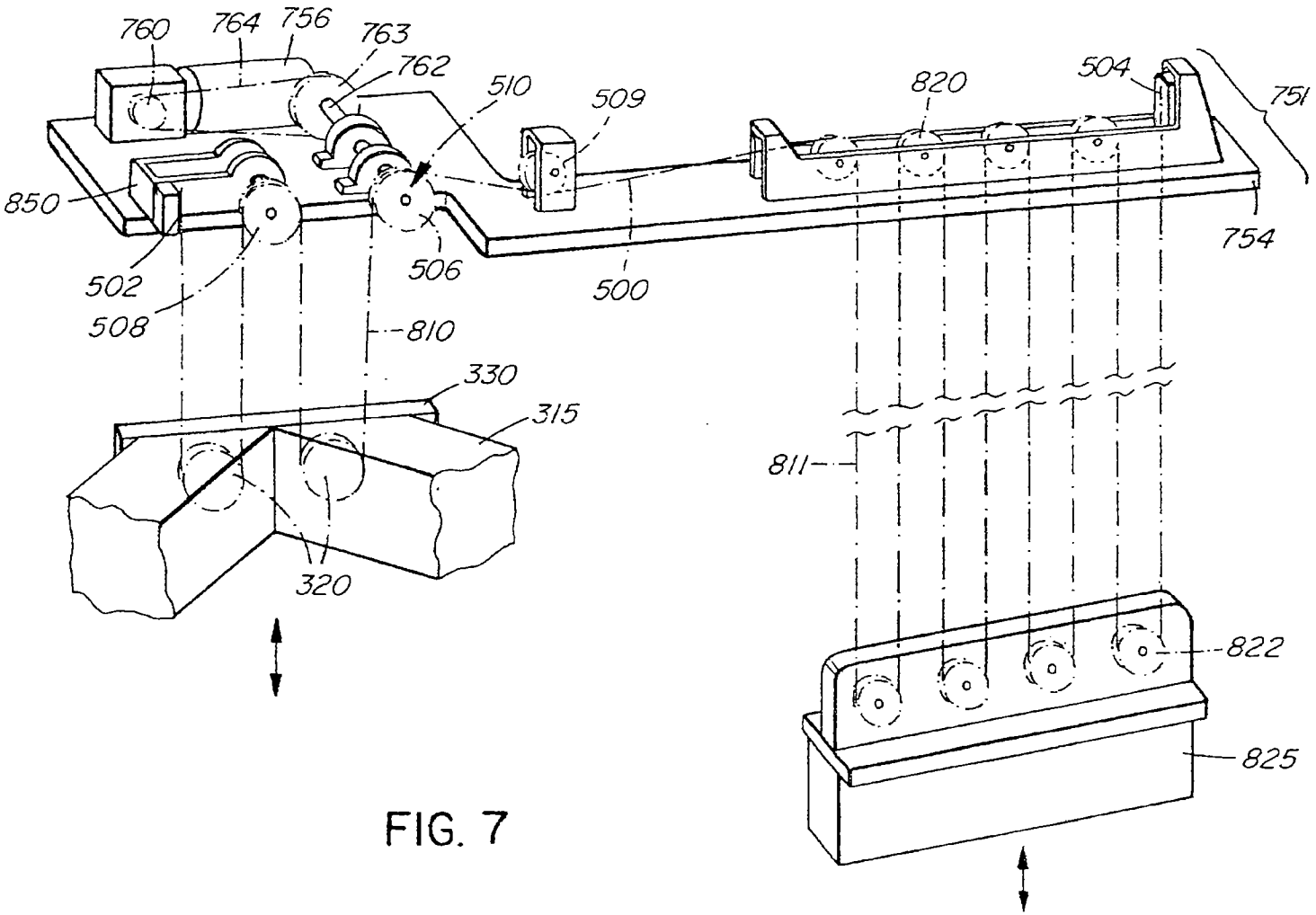
FIG. 7. is a support chain assembly according to the first embodiment.

The operation and structure of the supporting chain assembly is described with particular reference to FIGS. 4 and 7. Generally the support chain 500 may have an associated drive assemblies 751, which may comprise one or more powered drive sprockets 506 for displacing a length of the chain 500 to thereby vertically displace the elevator frame 300. Further detail of this general principle is now provided.

Vertical movement of the elevator 300 is driven by a drive assembly generally designated 751. The drive assembly 751 may comprise a mounting plate 754 which may comprise mountings for a range of other structures such as sprockets, a motor and the like. The drive assembly 751 may comprise a motor 756, one or more drive sprockets 506 for displacing the support chain 500, and one or more idler sprockets 508, 509, 820. Motor 756 with a power sprocket 760, which by means of a loop chain 764 drives a driven sprocket wheel 763 and thence a drive sprocket 506 mounted on a common axle 762 with driven sprocket 763. Thus when driven sprocket wheel 763 is rotated by powered chain 764, then drive sprocket 506 is also rotated. Support chain 500 rests over drive sprocket 506 and over additional sprockets which may be idler sprockets 508, 509, 820 or may be powered. Thus the drive may comprise one or more drive sprockets 506 and the drive sprocket 506 may be accompanied by additional passive idler sprockets 508, 509, 820 which may served to distribute weight from the chain 500. Support chain 500 runs backwards and forwards around the sprockets 506, 508, 820 of the drive assembly and supporting sprockets 320 on elevator 300, and idler sprockets 822 on counterweight 825. In embodiments drive sprockets, idler sprockets and supporting sprockets may be provided in any suitable numbers and arrangements. It will be understood that the drive assembly 751 is positioned substantially vertically above the support points on the elevator 300 bearing supporting sprockets 320 as will be seen particularly in FIG. 5.

Free ends 502, 504 of support chain 500 may be anchored proximate to or relative to or as part of the drive assembly 751. Such anchoring may be achieved by means of a chain anchor or clamp generally designated 800 and further illustrated in FIGS. 8A, B and C. It will be seen that support chain 500 is secured between two opposable combs 801, 802 whose teeth 804 and chain receiving recesses 805 are sized to fit snugly into and around the links of chain 500. It will also be seen that the combs 801, 802 are the same or similar size and shape but are reversed in orientation for use, and that they comprise tooth receiving recesses 806 for receiving teeth 804 on an opposed comb. Once opposed and closed so as to hold the chain 500, the combs 801, 802 are secured together and to a suitable mounting 808 or other suitable structure by insertion therethrough of bolts 809, to thereby immobilise a portion of chain 500 therebetween and to anchor it to the mounting 808. As a result of the relative anchoring of opposed chain ends 502, 504 the chain may be of a fixed length.

With regard to the chain arrangement, a first length 810 of chain extends on a first side of the drive sprocket 506, which contacts the chain 500 at a drive point 510, and a second length 811 of chain extends on a second side of the drive point 510. The first length 810 of chain 500 loops around hoist platform suspension sprockets 320. It will be seen that chain 500 passes alternately over the drive and idler sprockets 506, 508 and platform or frame supporting sprockets 320. On the second side of the drive point 510, the second length 811 of chain 500 passes alternately over idler sprockets 820 of the drive assembly 751 and idler sprockets 822 on counterweight 825. A wide range of alternative arrangements and assemblies for a counterweight assembly will be readily understood and applied by those skilled in the art.

It will be seen that the support chain 500 contacts the drive sprocket 506 at a point (also referred to as a drive point) 510, a first length 810 of chain 500 extends on a first side of the drive point 510 and a second length 811 of the chain 500 extends on a second side of the drive point. The elevator platform or frame 300 is slidingly supported on the first length 810 and the counterweight 852 is slidingly supported on the second length 811. It will be seen that when chain 500 is displaced by drive sprocket 506 to thereby lengthen the first length 810 of chain 500, then the second length of chain 811 will shorten. Consequently the elevator 300 will move lower and the counterweight 825 will rise to counterbalance the movement of the elevator 300. Conversely when the direction of rotation of drive sprocket 506 is reversed to shorten the first length 810 of chain 500 then the second length 811 of chain 500 will lengthen. The elevator 300 will accordingly rise and the counterweight 825 will sink. Because the free ends 502, 504 of the chain are fixed the movements of the elevator 300, and the counterweigh 825 help to balance one another.

In an embodiment the elevator frame 315 may have associated therewith a target for detection by a sonic sensor mounting on the side of the shaft. The device may comprise a sensor to slow the movement of the platform or frame to a creep when it reaches a predetermined proximity to the top or bottom of the shaft, and the predetermined proximity may be more than about 20 cm, 30 cm, 40 cm, 50 cm, 60, cm or more. Every time the apparatus reaches the top of its range then the sonic sensors may be used to level the platform or frame. The apparatus may also comprise an emergency stop to prevent the platform or frame moving beyond its safe range. The nature, implementation and adaptation of these components and systems is well known in the prior art and will be readily understood by those skilled in the art.

4. Guides and Accessory Features

Figure 2:
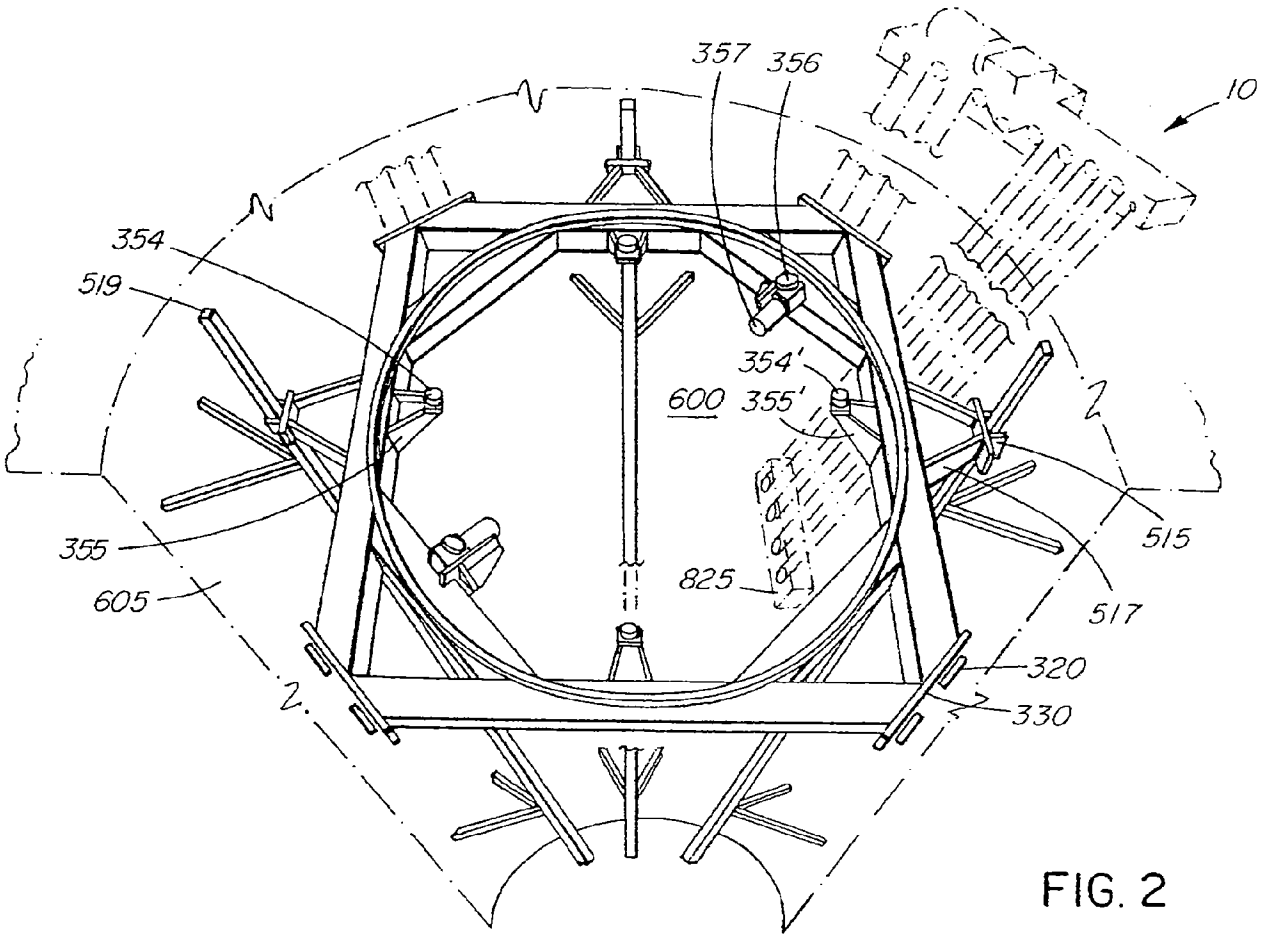
FIG. 2 is a cutaway view of an elevator platform in a pit of the first embodiment, with some structures omitted or shown in shadow for clarity.
Figure 3A:
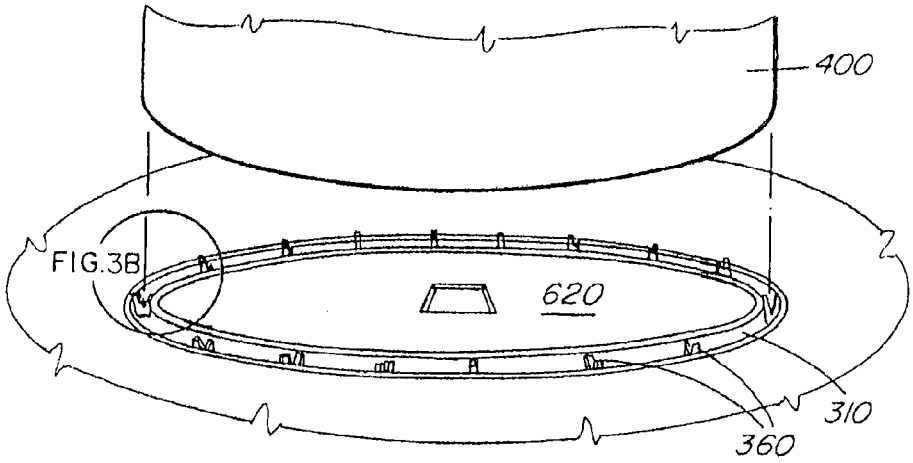
FIG. 3A is a surface view of the first embodiment showing the turntable in the raised position with the workpiece mounting ring and lugs visible.
Figure 3B:
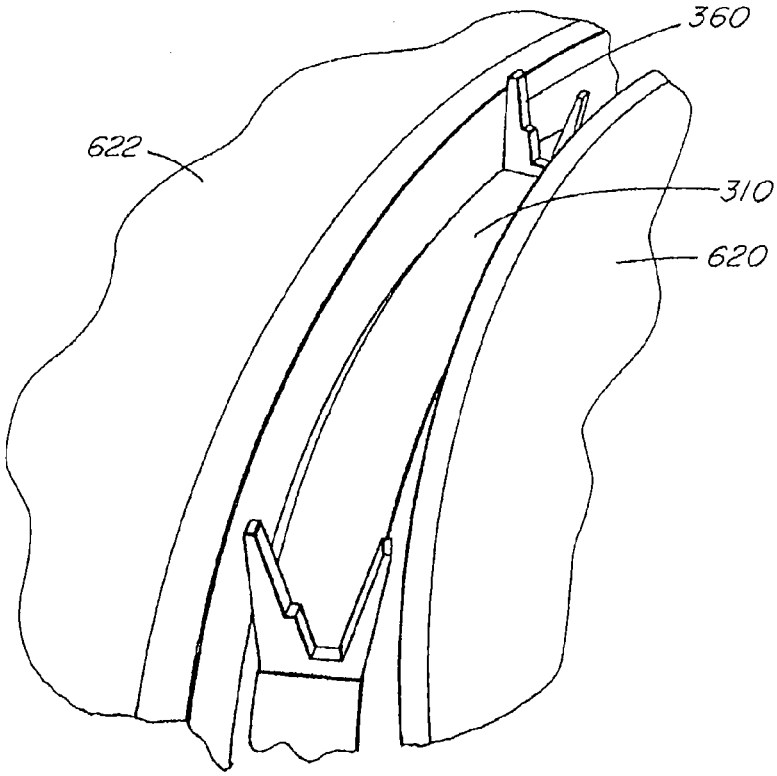
FIG. 3B is a close-up of FIG. 3A.

As generally seen in FIGS. 1,2 and 4, in embodiments there are provided one or more guide elements (also referred to as guide rods or guides) 519 which extend vertically in the shaft 600 and may be secured or stabilised relative to the shaft wall 605 by ties 606. Guide rods 519 may be substantially square or rectangular in cross section but any suitable cross section may be adopted with suitable adjustments to the apparatus. In some embodiments the guides may be or comprise metal plates or angle brackets. The dimension of shoes 515 will be chosen to cooperate with the guides 519.

The guide shoes 515 of elevator platform or frame 315 may comprise or may also serve as alignment brackets or dampers in that while slidingly engaging ones of guide rods 519 they serve to maintain the rotational alignment of the platform 315 at all times, even when the platform is exposed to vertical or rotational forces. Additional guide brackets or dampers 517*a* comprising shoes 515*a* may be comprised in the platform extensions 335 where these are provided. The damper brackets 517*a* (or 517 where no platform extensions are provided) and their shoes 515 are mounted on platform 300 and may comprise pads 518 to maintain a snug sliding fit with a cooperating guide rod 519. It will be understood that in embodiments the alignment brackets or dampers may be of any shape or size compatible with sliding engagement with their cooperating guide rods and their sliding contact may be achieved by means of rollers, or the like. It will also be understood that in embodiments the guide rods may comprise a recess or groove and the alignment brackets may then be shaped to engage said recess or groove. A range of alternative forms of and numbers of guide rods and alignment brackets will be readily apparent to those skilled in the art all without departing from the spirit of the subject matter claimed.

The guide rods or elements 519 may further comprise an angle iron or equivalent structure to guide movement of the counterweights which may themselves comprise suitable combinations of shoes to stabilise the movement of the counterweight against both arms of the angle iron all in ways readily understood in the art.

The function of the apparatus overall is controlled via an operator input. The apparatus can either raise or lower the elevation of the elevator frame 315 either by constant manual actuation of the appropriate control signal, or by automatic requested elevation stop points predetermined by an operator or computer system. An operator interface (also termed a human machine interface or HMI) consists of operator controlled switches for raising and lowering the elevator, an emergency stop, and an option for resetting of the system. A programmable operations screen may be provided for calibrating and monitoring the system. The function of the interface may be managed by a PLC (Programmable Logic Controller). The PLC may control the rate of elevation through feedback from measured height from encoders or any type of distance measurement system. The feedback may be delivered via process signal to a VFD (Variable Frequency Drive) which controls the speed of the drives 505 that move the elevator 300 up and down. Each motor 505 and control is equipped to operate a braking mechanism to hold and suspend the elevator 300 in place when not in motion. In addition to controlling the function of the elevator platform the PLC may be used to monitor the status of the VFD's, elevation status and the status of all safety switches used to protect the operator or the apparatus.

Vertical motion of the platform is controlled by a VPP (Vertical Placement Positioner), which can be operated in both annual and automatic controls. In manual mode the position of the platform is directly selected by the user, in automatic mode the platform will travel to a predetermined vertical position within the shaft. In manual mode, when movement is initiated, the VPP travels at a reduced "Creep Speed" for a preset time (which may typically be about 3 to 5 seconds) then increases to "Travel Speed" which continues until the actuator switch is released or travel limits are reached and a stop is thereby triggered. In automatic operation the VPP will travel in the desired direction to a predetermined location entered on the HMI. The rate of travel is determined by the faster "Travel speed". Upon achieving the requested position VPP returns to "Manual Mode". In both manual and automatic mode, movement is achieved by releasing motor brakes, then energizing drive motors operating in the required direction at the preset rate of travel until desired location of the platform is achieved. Movement is then stopped by de-energizing the motors and re-applying motor brakes. Where a plurality of drives are used to suspend and move the platform the distance traveled must be kept synchronized between all the drives during the travel period so that the platform remains level. This is achieved through continuous measurement of elevation by an encoder system reporting to a PLC (Programmable Logic Controller) where rate adjustments are made to the rate of travel of the different drives maintain a synchronized motion and synchronized start stop position.

In embodiments laser sensors may be provided to accurately determine the vertical positions of a plurality of points on the elevator and such position information may be received and used by the VPP or PLC to maintain levelling of the elevator within desired tolerances.

By way of example, where, as in the illustrated embodiment, four drive assemblies 751 and associated support chains 500 are provided, a first drive motor, motor #1 is activated and continuously updating its position and at the same time motors 2, 3 and 4 are activated and also updating their position. Motor #1 is the master motor and it's status acts as the reference for all the others. Thus motors 2, 3 and 4 adjust their rate of travel to stay synchronized with the moving position of motor #1. Should motors 2, 3 or 4 become out of the predetermined synchronisation parameters then movement of the platform is halted until the condition is corrected. In particular embodiments the threshold may be set so that the motors are no more than about 1.2 inches out of synchronisation. It will be understood that in particular embodiments this threshold may be modified to require more precise levelling of the platform, or to allow a greater disparity between the operation of different drives.

Auditing of the "home position" located at the top of travel is done via a distance measurement device which re-orientates the drives to the "0" point or "home position". This function occurs automatically each time the VPP returns to the top of its travel. The chain monitoring devices are used to continuously audit chain tension status. These devices report chain or drive failure as well as uneven chain tension to the Operator via HMI.

Figure 9:
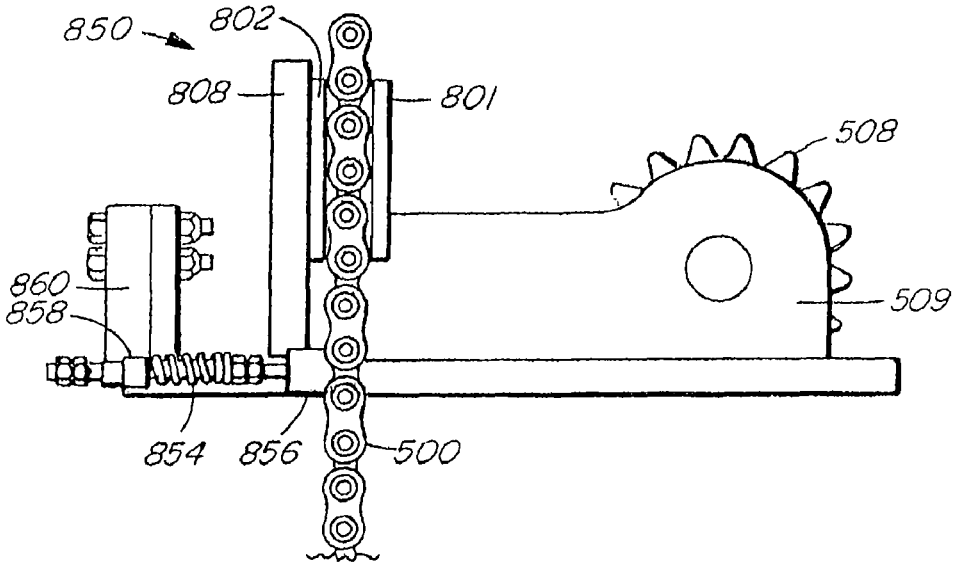
FIG. 9 is a chain tension sensor of the first embodiment.
Figure 8A:
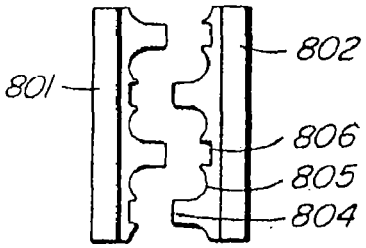
FIG. 8A is the combs of a chain anchor according to the first embodiment
Figure 8B:
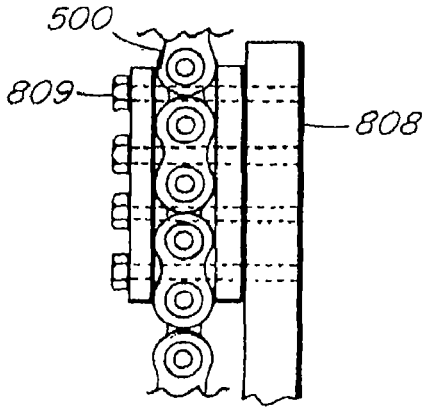
FIG. 8B is an assembled chain anchor comprising the combs according to FIG. 8A
Figure 8C:
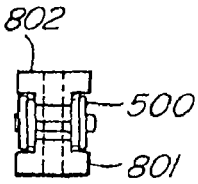
FIG. 8C is a cross section of a chain anchored between the combs according to FIGS. 8A and 8B.

In embodiments the control system or safety system may comprise a chain brake which may comprise or may be a tension sensor generally designated 850 and as illustrated in FIG. 9 and may also be referred to as a chain tension sensor. The plunger 852 may be under pressure from a spring 854 and may press against a supporting chain 500 at a first plunger end 856 while the other end 858 of the spring may press against a load cell 860. If the supporting chain 500 breaks or loses tension, this relieves pressure on the load cell 860 and the change may be detected by a programmable logic controller (PLC) which may consequently stop or adjust the operation of one or more drive motors 756.

6. Workstation and Controls for the Apparatus

In embodiments, inner work station 620 and outer work station 622 may comprise welding robots or may be configured for use by a human welder. Where used, robots may be preferably six axis industrial robots. It will be understood that, while workstations are shown with only one working level, more than one working level may be included. It will be understood that work piece 400 may be any structure with a continuous wall, such as cylindrical, oblong, oval, square, rectangular, or the like. A cylindrical work piece 400 is shown in the accompanying drawings, and discussed below as an the example only. Those skilled in the art will be aware that modifications may be made to accommodate structures, that are other than cylindrical.

At the bottom and top of the shaft 600 there may be provided position limit switches. A limit switch may shift the platform to a creep mode. In normal operation it may move at up to about 8 feet per minute, whereas the creep mode may be about 6 inches per minute. When the platform gets to the top of its travel the position may be sensed by ultrasonic measurement devices. As it passes a fixed distance the encoders are rezeroed to keep all motors in sync, this distance may be about 30 cm from top of stroke. There may also be provided high and low extremity stops that will act as the emergency stops and stop motion as the platform approaches the end of the possible range of movement. In manual mode there may be simple up and down control provided. For first five seconds of motion the platform may travels at creep speed before shifting to full speed.

There may also be provided an emergency switch hard wired into all motors and which may stop all motion. A reset may also be provided for the motor controls. A limit switch may be provided for the access hatch so that operation stops while the hatch is open.

7. Methods of Assembling a Workpiece

Figure 12C:
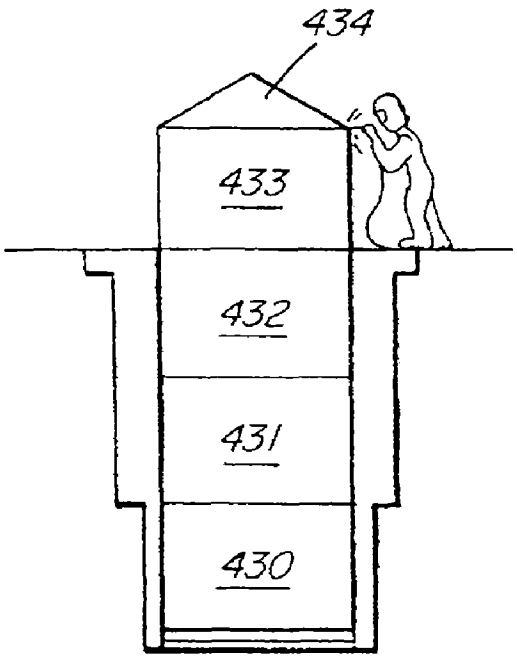
FIG. 12 is a schematic illustration of an assembly method according to the first embodiment.

Methods of using embodiments are described with particular reference to FIGS. 4 and 12 and more generally with reference to all of FIGS. 1 through 13.

Figure 12B:
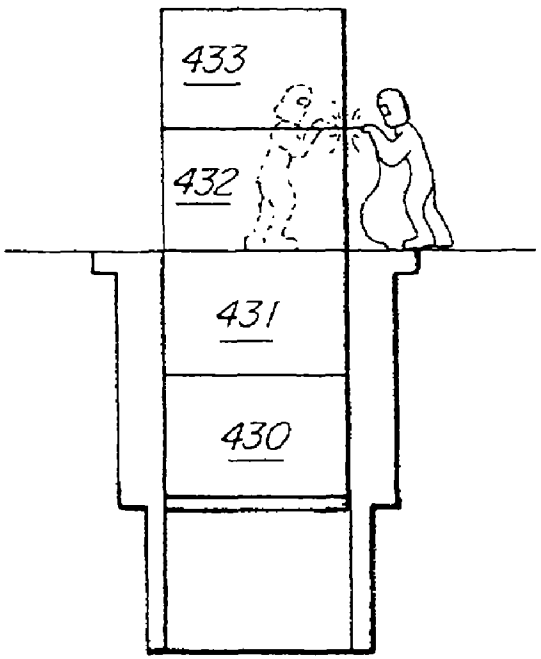
Figure 12A:
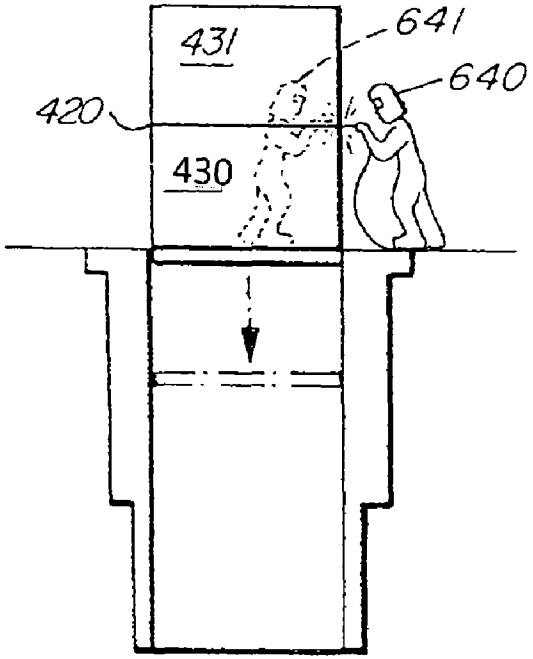

There is disclosed a method of assembling a workpiece 400 comprised of a plurality of sections, 430, 431, 432 and 433. The method generally comprises the steps of stacking first and second workpiece sections 430, 431 on a turntable elevator 300; and sliding the elevator 300 along a support chain 500 to thereby vertically position the workpiece 400. In practice, a first workpiece section 430 may be placed on the elevator turntable 300 with the elevator at a first position, then if desired the elevator 300 may be lowered to a second lower position so that the upper end of the workpiece section 430 is readily accessible to a worker or robot 640 at a workstation 620, 622. A second workpiece section 431 may then be lowered onto the top of the first workpiece section 430 in alignment therewith as shown for example in FIG. 12A. One or more workers or welders 640, 641 (which may be or comprise human or robot welders) may then access the join 420 between the two workpiece sections to weld the two together. It will be apparent that such access may be from inside or outside the partially constructed workpiece, using the inner and outer workstations 620, 622 as desired. It will be further understood that with the elevator in a chosen elevation position and adjacent workpiece sections positioned for welding, the turntable 315 may be rotated at a desired speed so that any worker or robot may carry out its welding operation from one location, while the join 420 between the workpiece sections 430, 431 is progressively moved relative to the workstation. When the first two sections 430, 431 have been duly welded together, the elevator 300 may be lowered to a desired lower position and a third workpiece section 432 may be added in the same way as the second. This process may be repeated sequentially until the desired number of sections have been joined as illustrated in FIG. 12B. If the workpiece is a tank or other structure that is to be closed at one end, then when the desired number of sections have been joined a top 434 may be welded onto the workpiece 400 and the elevator 300 may be raised and the workpiece 400 hoisted off and moved to a desired location, or alternatively the workpiece 400 may simply be hoisted off the lowered elevator and moved.

In practice it has been found that it may be preferable to hoist the assembled tank directly off the lowered elevator as raising the elevator bearing an assembled workpiece may place undue strain on the supporting chains 500 and associated apparatus. Once the workpiece 400 has been removed from the elevator 300 the workpiece it may be finished, for instance by adding valves, pipes, access hatches, and a base, and such other modifications as desired can be made.

In particular embodiments the rotation of the turntable 305 may cause undesired reverse rotation of the elevator frame 315, and the method may therefore comprise damping such reverse rotation. In the illustrated embodiment the turntable elevator 300 is moveable from a position proximate ground level to any one of a plurality of possible positions in a shaft that extends below ground level, one or more workstations being proximate ground level and suitable to access the workstation on the elevator 300.

In particular embodiments the elevator 300 may be slidingly suspended from one or more support chains 500, and vertical movement of the elevator 300 may be achieved by longitudinally displacing the chain 500 at a drive point 510. A first length of the chain 810 extends on a first side of the drive point; a second length 811 of the chain 500 extends on a second side of the drive point 510; and the elevator frame 315 is slidingly suspended from the first length 810 and a counterweight 825 is slidingly suspended from said second length 811. In embodiments the support chain 500 may be a roller chain, and in embodiments the apparatus may use a drive sprocket 506 to engage the chain 500.

In an alternative embodiment there is disclosed a method of assembling a workpiece 400 on an elevator 300, the method characterised in: positioning the workpiece 400 on a turntable 305 on the elevator 300, vertically positioning the workpiece 400 by suspendedly sliding the elevator 300 along a support chain 500; and rotationally positioning the workpiece 400 by rotating the turntable 305. In embodiments the method may further comprise vertically displacing the elevator 300 in a shaft 600 to thereby position the workpiece 400 relative to a workstation 620 or 622 proximate ground level. In embodiments the elevator 300 may comprises a frame 315 and the method may further comprise damping unwanted rotation of the elevator frame 315.

In embodiments the method may further comprise the steps of: stacking two workpiece sections 430, 431 on the turntable 305, positioning the elevator 300 vertically relative to a workstation 620 or 622, which may be a welding station, and rotating the stacked sections 430, 431 relative to the workstation so that the stacked sections can be welded together effectively by a welder 640 at the workstation.

In a further alternative embodiment there is disclosed a method for continuously welding a joint 420 in a hollow workpiece 400 having first 415 and second 416 faces, the method comprising, providing a first welder 640 or a second welder 641 positioned to access a the first face 415 or second face 416 of the joint 420, rotating the workpiece 400 in coordination with the operation of the welder to thereby form a continuous weld along a length of the first or second face of the joint 420. The method may further comprise providing a second welder positioned to access the second face 416 of the joint 420, optionally in opposed relationship to the first welder 640, positioned to access the first face 415 and may comprise rotatingly moving said joint 420 between said first and second welders 640, 642 to thereby continuously simultaneously weld both first and second faces 415, 416 of said joint 420. In embodiments the workpiece 400 may be substantially cylindrical. It will be appreciated that the welders may be human or machine welders. It will be further understood that where first and second welders are used then one of the first and second welders may be positioned inside the workpiece 400 on the internal workstation 620 and one of the first and second 640, 642 welders may be positioned outside the workpiece 400 at the outer workstation 622. In embodiments the turntable 305 may be comprised in turntable elevator 300 actuable to slide along a support chain 500 to thereby vertically displace the elevator in a shaft 600 which may extend below a ground level workstation 620, 622.

It will be understood that in particular embodiments the lower workpiece section 430 may be positioned suitably on the turntable 305 by resting the lower edge 425 of the workpiece section 430 in lugs 360 provided on the turntable 305. Such positioning may comprise using guide elements 365 positioned on one or more limbs 362,363 of the lugs 360, to guide the edge 425 of the workpiece section 430 into the notch 364 at the bottom of a lug 360 and then removing the guide element 365 for operation of the apparatus.

It will be further understood that the hoisting and moving of workpiece sections can be accomplished using any conventional means, all of which will be readily apparent to those skilled in the art.

Where the workpiece 400 is a tank, then in a particular embodiment each tank segment may be approximately 8 ft high, with a 15 ft 3 inch diameter. The tanks may comprise 2, 3, 4, 5, 6 or more sections. Typically there may be four sections, each 8 feet high and the sections may be made from steel that is approximately ¼ inches thick. It will be apparent many variations are possible to the general embodiments disclosed herein. By way of example and not limitation, the sections may have all manner of dimensions, may be made from a variety of materials, and may be joined by a variety of methods such as welding, gluing, bolting, clipping and the like. Similarly, the dimensions and operation of the apparatus may be readily adaptable to suit different workpiece configurations in ways that will be readily apparent to those skilled in the art.

The embodiments and examples presented herein are illustrative of the general nature of the subject matter claimed and are not limiting. It will be understood by those skilled in the art how these embodiments can be readily modified and/or adapted for various applications and in various ways without departing from the spirit and scope of the subject matter disclosed and claimed. The claims hereof and the disclosure hereof are to be understood to include without limitation all alternative embodiments, all combinations of embodiments, and all equivalents of embodiments. Phrases, words and terms employed herein are illustrative and are not limiting. Where permissible by law, all references cited herein are incorporated by reference in their entirety.

What is claimed is:

1. An elevator for holding a workpiece, said elevator comprising a platform;

at least two spaced pairs of sprockets on the platform;

a turntable rotatably mounted on the platform; and a support chain, the support chain operatively connected to at least one of said pairs of sprockets for suspending the platform along the support chain; and a powered bi-directional chain drive for displacing a length of said chain for vertically positioning the platform along said support chain.

2. The elevator according to claim 1 wherein said chain is a roller chain.

3. The elevator according to claim 1, wherein said support chain has two fixed ends, said platform moves relative to both of said fixed ends, and wherein said vertically positioning occurs at a point distant from said fixed ends.

4. The elevator according to claim 1 further comprising a rotation damper.

5. The elevator according to claim 1 wherein said chain drive comprises a powered sprocket for displacing the length of said chain.

6. The elevator according to claim 5 wherein said chain contacts said chain drive at a drive point, and wherein:

a first length of said chain extends on a first side of said drive point, a second length of said chain extends on a second side of said drive point, and wherein said platform is supported on said first length and a counterweight is supported on said second length.

7. A workpiece holding apparatus, comprising:

a workstation; and a workpiece supporting elevator actuable to support a workpiece and to position the workpiece vertically and circumferentially relative to the workstation, the elevator including a platform, at least two spaced pairs of sprockets on the platform, and a turntable rotatably mounted on the platform;

a support chain, the support chain operatively engaging at least one of the pairs of sprockets for suspending the elevator on the support chain; and a powered bi-directional chain drive for displacing a length of said chain for vertically positioning said elevator along said support chain.

8. The apparatus according to claim 7 wherein said chain drive contacts said chain at a drive point, and wherein a first length of said chain extends on a first side of said drive point and a second length of said chain extends on a second side of said drive point, and further comprising a counterweight slidingly suspended from said first length and wherein said elevator is slidingly suspended from said second length.

9. The apparatus according to claim 7 wherein said chain is a roller chain.

10. The elevator according to claim 1 further comprising third and fourth pairs of spaced apart of sprockets on said platform, and second, third and fourth chain drives operatively connected to respective pairs of the sprockets.

* * * * *